US008590110B2

(12) United States Patent
Iten et al.

(10) Patent No.: US 8,590,110 B2
(45) Date of Patent: Nov. 26, 2013

(54) SAW-TOOTH CLOTHING FOR A TEXTILE MACHINE

(75) Inventors: Josef Iten, Schmerikon (CH); Felix Hasler, Winterthur (CH); Nikolaos Pavlou, Rapperswil-Jona (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 13/442,004

(22) Filed: Apr. 9, 2012

(65) Prior Publication Data

US 2012/0255143 A1 Oct. 11, 2012

(51) Int. Cl.
*D01G 15/84* (2006.01)

(52) U.S. Cl.
USPC ..... 19/114

(58) Field of Classification Search
USPC ..... 19/114; 57/315, 327, 408, 412; D15/78
See application file for complete search history.

(56) References Cited

U.S. PATENT DOCUMENTS

| | | | | | |
|---|---|---|---|---|---|
| 2,937,413 | A * | 5/1960 | Hollingsworth | 19/114 |
| 3,231,941 | A * | 2/1966 | Flynn, Jr. | 19/106 R |
| 3,419,941 | A * | 1/1969 | Moriwaki | 19/234 |
| 4,625,367 | A * | 12/1986 | Sole-Leris | 19/113 |
| 4,651,387 | A * | 3/1987 | Giuliani | 19/113 |
| 4,653,152 | A * | 3/1987 | Wada | 19/114 |
| 4,964,195 | A * | 10/1990 | Hollingsworth | 19/114 |
| 5,428,949 | A * | 7/1995 | Stahlecker | 57/408 |
| 5,566,541 | A * | 10/1996 | Stahlecker et al. | 57/408 |
| 5,581,848 | A * | 12/1996 | Egerer | 19/114 |
| 6,185,789 | B1 * | 2/2001 | Hollingsworth et al. | 19/114 |
| D445,433 | S * | 7/2001 | Hollingsworth | D15/78 |
| 6,408,487 | B1 * | 6/2002 | Atkinson | 19/114 |
| 6,523,226 | B2 * | 2/2003 | Graf | 19/114 |
| 6,920,671 | B2 * | 7/2005 | Graf | 19/114 |
| 6,920,747 | B2 * | 7/2005 | Burchert | 57/408 |
| 7,818,848 | B2 * | 10/2010 | Maerz | 19/114 |
| 2001/0037541 | A1 * | 11/2001 | Graf | 19/114 |
| 2004/0128800 | A1 * | 7/2004 | Graf | 19/114 |

FOREIGN PATENT DOCUMENTS

| | | | |
|---|---|---|---|
| DE | 4038352 | A1 * | 6/1992 |
| JP | 61012922 | A * | 1/1986 |
| JP | 62078221 | A * | 4/1987 |
| WO | WO 9424348 | A1 * | 10/1994 |

* cited by examiner

*Primary Examiner* — Shaun R Hurley
(74) *Attorney, Agent, or Firm* — Dority & Manning, P.A.

(57) ABSTRACT

The invention relates to a saw-tooth clothing for rollers of a carding machine or a carder. The saw-tooth clothing has a multiplicity of successively arranged teeth, wherein each tooth has a tooth front and a tooth back and a tooth tip. The tooth backs of the teeth have in each case a certain distance from the tooth front of the in each case following tooth and form a tooth space which extends from a tooth root to the tooth tips. Between the tooth tips and the tooth root, the teeth have in each case on their tooth back and on their tooth front at least one embossment which reduces the distance between the tooth back of the teeth and the tooth front of the in each case following tooth.

18 Claims, 2 Drawing Sheets

SAW-TOOTH CLOTHING FOR A TEXTILE MACHINE

FIELD OF THE INVENTION

The present invention relates to a saw-tooth clothing for rollers of openers, cleaners, carders or carding machines.

BACKGROUND

Saw-tooth clothings are used in different areas of processing textile fibers. In most cases, the saw-tooth clothings are mounted in the form of wires onto rollers. In a typical fiber-preparing process, the fibers are treated on so-called carders or carding machines as a preparation for the production of yarn or nonwoven fabrics. The fibers are fed via a feeding device to a drum, which is typically a roller provided with a hook- or saw-tooth clothing on its surface shell. The drum clothing together with the carding elements distributed over the circumference effects an alignment and a cleaning of the fed fibers. Depending on the product and the application, different elements arranged around the drum are used. The elements are configured as flats, cleaning elements, or rollers and can also be provided with a saw-tooth clothing. Subsequent to this treatment, the fibers are taken over by a doffer roller and removed from the drum clothing. In doing so, the clothing of the doffer roller engages in the fibers held by the clothing of the drum and detaches them from the drum. From the doffer roller, in turn, the fibers are transferred to a further roller and fed to a nonwoven fabric- or sliver-forming unit. Such takeover and transfer processes from one roller to another one can also be found at worker rollers of a carding machine.

From the prior art, different embodiments of saw-tooth clothings are known. For example, DE 100 12 561 discloses a saw-tooth clothing with a wave-shaped tooth back. This shaping of the tooth back is intended to prevent a premature detachment of the fibers from the saw-tooth clothing. The provided convex projection on the tooth back is intended to prevent the fibers from sliding off. A disadvantage of the disclosed clothing is that the shape of the tooth back prevents an early detachment only during a fiber takeover, but during the transfer of the fibers by the clothing, it does not provide any protection to prevent the fibers from sliding off. Based on this problem, DE 100 12 561 discloses an extremely pointed tip of the tooth in a further embodiment. However, in the course of use of the clothing, such a tooth tip gets lost due to wear.

Furthermore, EP 1 153 162 discloses a saw-tooth clothing, the teeth of which have an undercut edge on the tooth front. Said undercut edge is formed by a recess which points from the tooth front toward the back of the tooth. The disclosed tooth form is intended to increase the fiber retention during carding. The disadvantage of the disclosed clothing is that the form of the teeth represents a one-sided structure which is designed for firmly holding the fibers.

SUMMARY

It is an object of the invention to provide a saw-tooth clothing which, on the one side, provides for the fiber reception and fiber retention necessary for fiber processing and, on the other, affects the fiber transport and the fiber transfer to a following process stage only to such an extent that the fiber takeover can take place in a defined manner.

Additional objects and advantages of the invention will be set forth in part in the following description, or may be obvious from the description, or may be learned through practice of the invention.

In order to achieve the object, a saw-tooth clothing for rollers of a carding machine or a carder is proposed which has a multiplicity of teeth, wherein each tooth has a tooth front and a tooth back and a tooth tip, and the back of the teeth have a certain distance from the front of the following tooth and form a tooth space which extends from the tip of the tooth to a root of the tooth. Between the tooth tips and the tooth root, on their tooth front and on their tooth back, the teeth have in each case an embossment which reduces the distance between the back of the teeth and the front of the following tooth.

During the processing of fibers, the fibers are retained on rollers by means of clothings. For this purpose, clothings of many different designs are used, such as flexible clothings or saw-tooth clothings. With suitable counter elements, the fibers are cleaned and parallelized. Subsequently, the fibers are transferred from one roller to a next roller or, respectively, lifted by a next roller out of the clothing of the preceding roller. For this, on the one hand, the fibers have to be firmly held by a clothing on a roller during the rotational movement of the roller and, on the other, when required, have to be transferred to a clothing of a further roller.

Due to the rotational movement of the roller and therefore the movement of the clothing on the roller, the individual fibers wind to some extent around the teeth of the clothing in the case of a saw-tooth clothing. It was found that the tooth form or tooth position of the saw-tooth clothing used is not the only influence on the behavior of the fibers. Another decisive factor is the configuration of the free space between the successive teeth of the saw-tooth clothing. Through its geometry, this tooth space contributes substantially to the behavior of the individual fibers during the time in the saw-tooth clothing and the transfer to a further processing element, for example, a subsequent roller.

The fibers are retained in the saw-tooth clothing mainly by the tooth front. The tooth front extends from a tooth tip to a tooth root on the side pointing in the moving direction of the saw-tooth clothing. The side opposite to a tooth front of the same tooth is formed by the back of the tooth. In the tooth root, the tooth front of a tooth and the tooth back of the preceding tooth meet each other. The tooth space is therefore bordered by the tooth back of a tooth and the tooth front of the following tooth and extends from the tip of the tooth to the root of the tooth.

A fiber collected by the saw-tooth clothing thus can penetrate maximally to the tooth root of the saw-tooth clothing. In order to retain the fibers received by the clothing, an embossment is provided on the tooth front between the tooth tip and the tooth root. This embossment results in that at the position of the embossment, the distance between the tooth back of the preceding tooth and the tooth front of the tooth provided with the embossment is reduced. The fiber to be treated slides on the embossment on the tooth front toward the tooth root and is subsequently retained in the saw-tooth clothing by the embossment.

In order to remove the fibers from the clothing, the clothing on an adjacent roller engages with the fibers. In doing so, the fibers are accelerated in the moving direction of the clothing holding the fibers and are lifted out of the clothing via the tooth back of the tooth positioned in each case before the fibers. To ensure that the fibers cannot mutually pull each other out of the clothing due to the adhesive forces of adjacent fibers, the back of the tooth is also provided with an embossment which results in a further reduction of the distance between the tooth back and the tooth front of the following tooth.

In a preferred embodiment, the embossment on the tooth back of the one tooth is arranged opposite the embossment on the tooth front of the following tooth, whereby the embossments form a bottleneck of the tooth space. The embossments are to be considered as opposing when, viewed from the tip of the tooth in the direction of the root of the tooth, said embossments are not arranged one behind the other, but at least partially overlapping. The way of viewing is always perpendicular to the tooth rib. In a cross-section arranged perpendicular to the tooth rib, the rise of the embossment on the tooth back begins before the embossment on the tooth front ends, or vice versa. The distance from the tooth rib to the beginning of the rise of the embossment on the tooth back is larger than the distance from the tooth rib to the highest point of the embossment on the tooth front. Or, in the reverse case, the distance from the tooth rib at the beginning of the rise of the embossment on the tooth front is larger than the distance from the tooth rib to the highest point of the embossment on the tooth back. The beginning of the rise of the embossment is to be defined viewed from the tip of the tooth. The highest point of an embossment corresponds to the point at which the embossment protrudes the furthest into the tooth space. This arrangement of the embossments on the tooth front or, respectively, the tooth back, results in a baggy form of the tooth space. This ensures that the fibers retained by the embossment on the tooth front in the saw-tooth clothing are also influenced by the embossment on the tooth back of the preceding tooth when the fibers are being lifted off. This influence results in a defined transfer of the fiber from one roller to the next one, wherein the transfer is determined by the clothing of the roller taking over the fiber. It was also found that the embossment on the tooth back makes a significant contribution to the retention of the fibers in the saw-tooth clothing if the embossment on the tooth back is combined with an embossment on the tooth front.

The baggy form of the tooth space is characterized in that the distance between tooth back and the tooth front of the following tooth is larger before the bottleneck than after the bottleneck. A determination of the distance between two teeth is always performed parallel to a tooth rib of the saw-tooth clothing. The basic restriction of the tooth space in the direction toward the tooth root has the effect that the tooth space cannot be clogged with fibers which cannot be lifted out of the saw-tooth clothing by a clothing of a following roller.

In a further preferred embodiment, the tooth front is formed in such a manner that a first section of the tooth front before the embossment is aligned with a second section of the tooth front after the embossment. Where applicable, this applies also to the tooth back so that a first section of the tooth back before the embossment is aligned with a second section of the tooth back after the embossment. Such a configuration of the tooth front and the tooth back increase the uniformity of fiber removal from the saw-tooth clothing.

It was found that it is advantageous if, from the tip of the tooth in the direction toward the root of the tooth, the embossment on the tooth front rises with respect to the first section of the tooth front at an angle of less than 15°, preferably less than 10°. In this manner, no jerky sliding of the fibers into the saw-tooth clothing takes place. In the further course of the embossment on the tooth front, it is advantageous if, from the tip of the tooth in the direction toward the root of the tooth, the embossment falls parallel to the tooth rib toward the second section of the tooth front.

The formation of the embossment of the tooth back is advantageous if, from the tip of the tooth in the direction toward the root of the tooth, the embossment rises with respect to the first section of the tooth back at an angle of less than 15°, preferably less than 10°. In the further course of the embossment on the tooth back it is advantageous if, from the tip of the tooth in the direction toward the root of the tooth, the embossment falls perpendicular to the tooth root toward the second section of the tooth back.

The saw-tooth clothing is suitable in particular for doffer rollers and worker rollers of carders, carding machines and rollers in the nonwoven sector. The saw-tooth clothing is provided on a roller in such a manner that the saw-tooth clothing is mounted in spirally windings which are adjacent to each other. The saw-tooth clothing can be implemented with a normal, interlocking or interchaining tooth rib in order to enable mounting on an ungrooved roller.

The invention is explained in more detail hereinafter by means of an exemplary embodiment and with drawings.

DETAILED DESCRIPTION

Figure 1:
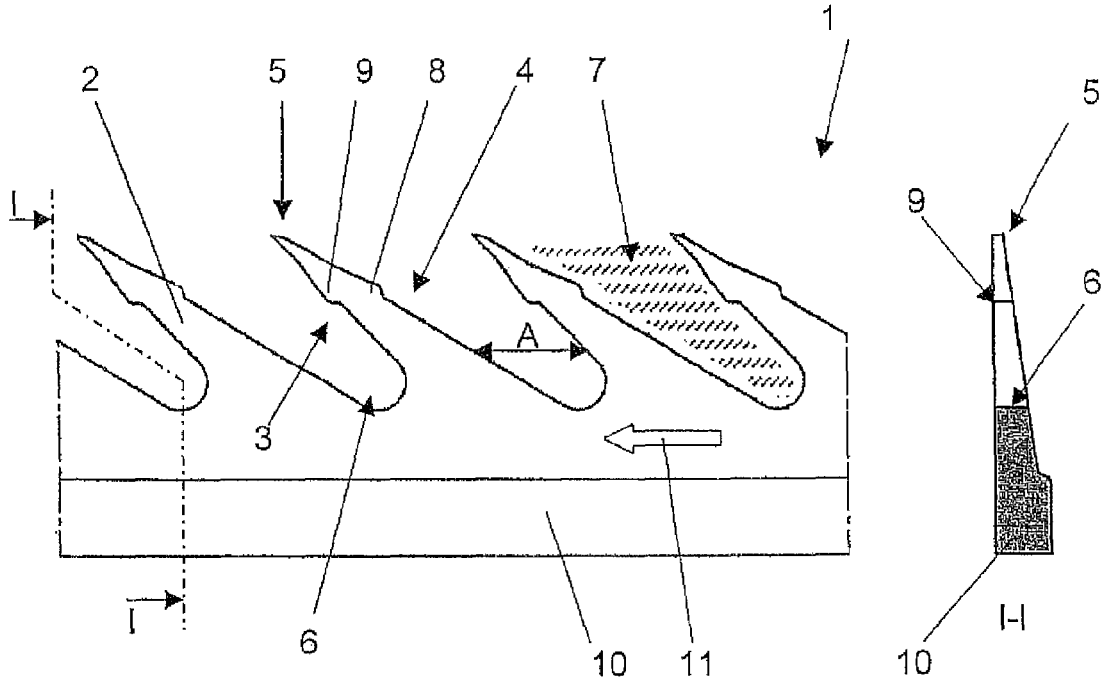
FIG. 1 shows a schematic illustration of a first embodiment of a saw-tooth clothing in one view and one cross-section.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic illustration of a first embodiment of a saw-tooth clothing 1 in one view and one cross-section. This involves a saw-tooth clothing 1 having a tooth rib 10 and a multiplicity of successive teeth 2 each with one tooth tip 5. The teeth 2 of the saw-tooth clothing 1 are formed such that a tooth front 3 extending from the tooth tip 5 to a tooth root 6, and a tooth back 4 extending from the tooth tip 5 to a tooth root 6 are generated. The tooth back 4 of a tooth 2 meets the tooth front 3 of the following tooth in the tooth root 6. An arrow 11 indicates the moving direction of the saw-tooth clothing 1. On its tooth front 3 and its tooth back 4, the tooth 2 has in each case one embossment 8, 9. The tooth back 4 of a tooth 2 and the tooth front 3 of a following tooth 2 border a tooth space 7 which extends from the tooth tips 5 to the tooth root 6. The distance A between the tooth back 4 of a tooth 2 and the tooth front 3 of the following tooth 2 is reduced by the embossments 8, 9.

Figure 2:
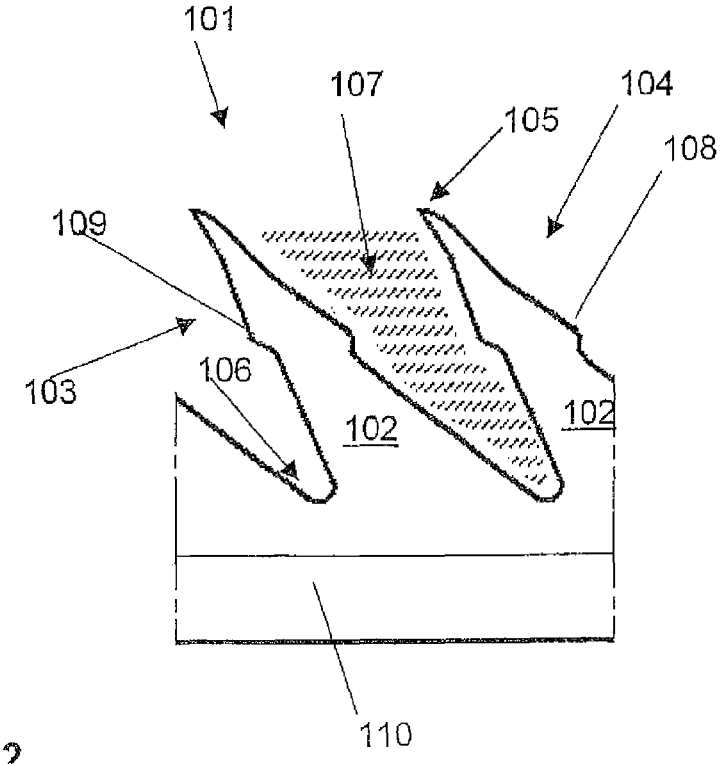
FIG. 2 shows a schematic illustration of a second embodiment of a saw-tooth clothing in one view.

FIG. 2 shows a schematic illustration of a second embodiment of a saw-tooth clothing 101 in one view. The saw-tooth clothing 101 differs from the FIG. 1 with regard to arrangement and form of the teeth 102. The saw-tooth clothing 101 consists of a tooth rib 110 and a multiplicity of teeth 102 each having one tooth tip 105. With respect to the teeth of the saw-tooth clothing of FIG. 1, the teeth 102 of the saw tooth clothing 101 are exemplary illustrated with a different inclination and a different distance. After the embossment 109, the course of the tooth front 103 continues to extend to the tooth root 106 at a different angle than before the embossment 109. The course of the tooth back 104 also continues to extend after the embossment 108 at a different angle than before the embossment 108. This results in a different form of the tooth space 107 with respect to FIG. 1, wherein the characteristic baggy form of the arrangement of the embossments 108, 109 remains unchanged.

Figure 3:
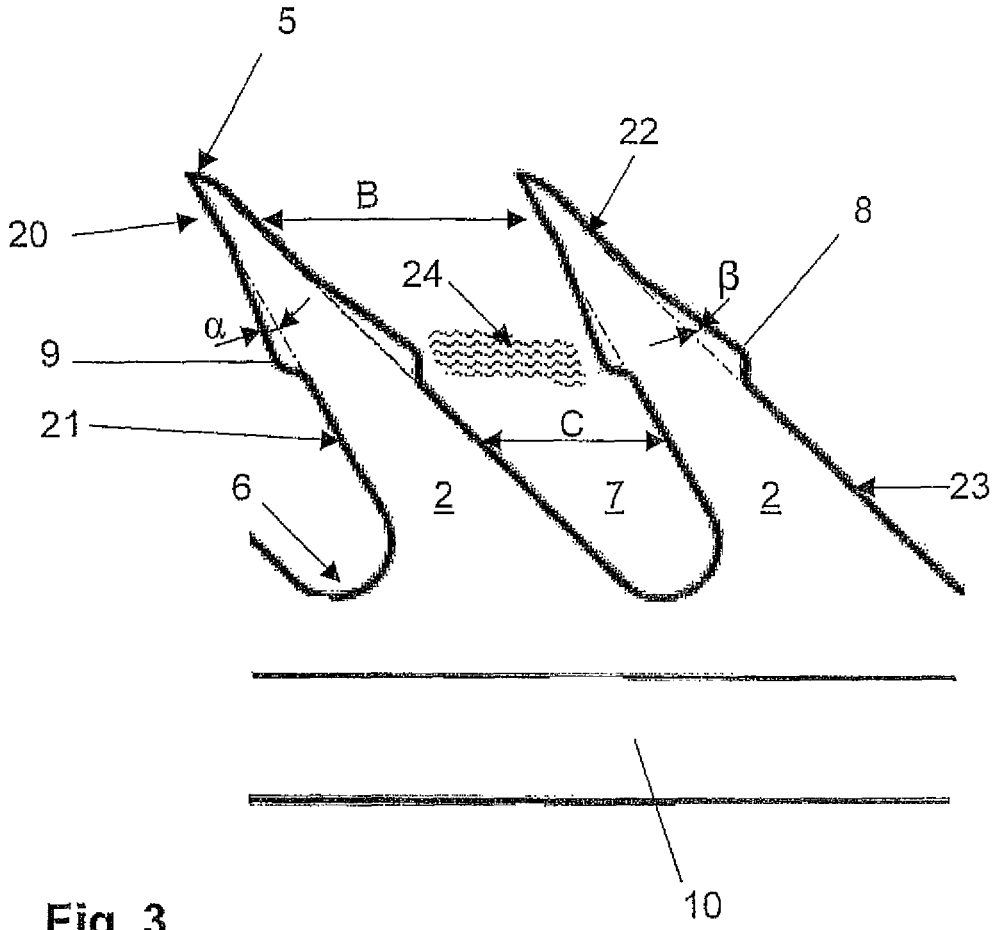
FIG. 3 shows a schematic illustration of two successive teeth of the saw-tooth clothing of FIG. 1.

FIG. 3 shows schematically two successive teeth 2 of the saw-tooth clothing 1 of FIG. 1 in an enlarged illustration. The embossment 8 on the tooth back of the tooth 2 is arranged opposite to the embossment 9 on the tooth front of the following tooth 2. The tooth front is divided by the embossment 9 into a first section 20 between the tooth tip 5 and the embossment 9, and a second section 21 between the embossment 9 and the tooth root 6. The first section 20 is arranged in alignment with the second section 21 of the tooth front. Therefore, the two sections 20, 21 of the tooth front are arranged in the same plane.

Likewise, the tooth back is divided by the embossment 8 into a first section 22 between the tooth tip 5 and the embossment 8, and a second section 23 between the embossment 8 and the tooth root 6. The first section 22 is arranged in alignment with the second section 23 of the tooth back. Therefore, both sections 22, 23 of the tooth back are arranged in the same plane.

The embossment 8 of the tooth back is arranged opposite to the embossment 9 of the tooth front of a following tooth. Thereby, a bottleneck 24 is formed in the tooth space 7, resulting in a baggy form of the tooth space 7. The distance B between the first section 22 of the tooth back of a tooth 2 and the first section 20 of the tooth front of a following tooth 2 is larger than the distance C between the second section 23 of the tooth back of a tooth 2 and the second section 21 of the tooth front of a following tooth 2. The width of the tooth space 7 thus decreases from the tooth tips 5 in the direction toward the tooth root 6, wherein by the embossments 8, 9 opposing each other, a continuous narrowing of the tooth space 7 is interrupted in the form of a bottleneck 24.

The form of the embossments 8, 9 is configured such that proceeding from the tooth tip 5 in the direction toward the tooth root 6, a gentle rise of the embossments 8, 9 is created. Here, from the tooth tip 5 in the direction toward the tooth root 6, the embossment 9 on the tooth front rises with respect to the first section 20 of the tooth front at an angle ($\alpha$) of less than 15°. Accordingly, the embossment 8 on the tooth back rises from the tooth tip 5 in the direction toward the tooth root 6 at an angle ($\beta$) of less than 15° with respect to the first section 22 of the tooth front. After reaching the highest point of the embossment 9 on the tooth front, the embossment falls parallel to the tooth rib 10 toward the second section 21 of the tooth front. Accordingly, the embossment 8 on the tooth back falls perpendicular to the tooth rib 10 toward the second section 23 of the tooth back.

Modifications and variations can be made to the embodiments illustrated or described herein without departing from the scope and spirit of the invention as set forth in the appended claims.

The invention claimed is:

1. A saw-tooth clothing for rollers of a carding machine or a carder, comprising:

a plurality of successively arranged teeth, wherein each tooth has a tooth front, a tooth back, and a tooth tip;

a tooth space that extends from a tooth root to the tooth tips between successive teeth, the tooth space having a certain distance (A) from the tooth back to the tooth front of the following tooth;

at least one embossment defined on the tooth back and tooth front of the teeth between the toot tip and tooth root, the embossments having a shape such that the distance (A) between the tooth back and the tooth front of successive teeth is reduced as compared to a first section of the tooth back and tooth front before the embossment and as compared to a second section of the tooth back and tooth front after the embossment in a direction towards the tooth root.

2. The saw-tooth clothing as in claim 1, wherein the embossment on the tooth back is arranged opposite from the embossment on the tooth front of each tooth such that the embossments of successive teeth define a bottleneck restriction in the certain distance (A).

3. The saw-tooth clothing as in claim 2, wherein a distance (B) between the first sections of successive teeth is greater before the bottleneck restriction than a distance (C) after the bottleneck restriction in a direction towards the tooth root.

4. The saw-tooth clothing as in claim 1, wherein the embossment rises at an angle ($\alpha$) of less than 15 degrees relative to the first section on the tooth front in a direction towards the tooth root.

5. The saw-tooth clothing as in claim 4, wherein the embossment on the tooth front reduces to the second section in a direction parallel to a tooth rib of the clothing.

6. The saw-tooth clothing as in claim 1, wherein the embossment rises at an angle ($\beta$) of less than 15 degrees relative to the first section on the tooth back in a direction towards the tooth root.

7. The saw-tooth clothing as in claim 6, wherein the embossment on the tooth back reduces to the second section in a direction perpendicular to a tooth rib of the clothing.

8. The saw-tooth clothing as in claim 1, wherein the first section of the tooth front before the embossment on the tooth front is angularly aligned with the second section of the tooth front after the embossment.

9. The saw-tooth clothing as in claim 1, wherein the first section of the tooth back before the embossment on the tooth back is angularly aligned with the second section of the tooth back after the embossment.

10. A doffer roller for a carding machine, the doffer roller comprising a saw-tooth clothing, wherein the saw-tooth clothing further comprises:

a plurality of successively arranged teeth, wherein each tooth has a tooth front, a tooth back, and a tooth tip;

the tooth backs having a certain distance (A) from the tooth front of the following tooth and forming a tooth space that extends from a tooth root to the tooth tips;

at least one embossment defined on the tooth back and tooth front of the teeth between the toot tip and tooth root, the embossments having a shape such that the distance (A) between the tooth back and the tooth front of the following tooth is reduced as compared to a first section of the tooth back and tooth front before the embossment and as compared to a second section of the tooth back and tooth front after the embossment in a direction towards the tooth root.

11. The doffer roller as in claim 10, wherein the embossment on the tooth back is arranged opposite from the embossment on the tooth front of each tooth such that the embossments of successive teeth define a bottleneck restriction in the certain distance (A).

12. The doffer roller as in claim 11, wherein a distance (B) between the first sections of successive teeth is greater before the bottleneck restriction than a distance (C) after the bottleneck restriction in a direction towards the tooth root.

13. The doffer roller as in claim 10, wherein the embossment rises at an angle ($\alpha$) of less than 15 degrees relative to the first section on the tooth front in a direction towards the tooth root.

14. The doffer roller as in claim 13, wherein the embossment on the tooth front reduces to the second section in a direction parallel to a tooth rib of the clothing.

15. The doffer roller as in claim 10, wherein the embossment rises at an angle ($\beta$) of less than 15 degrees relative to the first section on the tooth back in a direction towards the tooth root.

16. The doffer roller as in claim 15, wherein the embossment on the tooth back reduces to the second section in a direction perpendicular to a tooth rib of the clothing.

17. The doffer roller as in claim 10, wherein the first section of the tooth front before the embossment on the tooth front is angularly aligned with the second section of the tooth front after the embossment.

18. The doffer roller as in claim 10, wherein the first section of the tooth back before the embossment on the tooth back is angularly aligned with the second section of the tooth back after the embossment.

* * * * *